US010863882B2

(12) United States Patent
Olesen et al.

(10) Patent No.: US 10,863,882 B2
(45) Date of Patent: Dec. 15, 2020

(54) APPLIANCE DRYING DUCT

(71) Applicant: Electrolux Home Products, Inc., Charlotte, NC (US)

(72) Inventors: Jerry Lee Olesen, Kinston, NC (US); Janusz Sendor, New Bern, NC (US); Veronica Hope Davenport, Snow Hill, NC (US); Michael Anthony Phillips, Goldsboro, NC (US); Christopher Shaw Burch, Charlotte, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 23 days.

(21) Appl. No.: 16/102,079

(22) Filed: Aug. 13, 2018

(65) Prior Publication Data

US 2020/0046197 A1 Feb. 13, 2020

(51) Int. Cl.

| | |
|---|---|
| ***A47L 15/48*** | (2006.01) |
| ***A47L 15/00*** | (2006.01) |
| ***A47L 15/42*** | (2006.01) |

(52) U.S. Cl.

CPC ..... *A47L 15/488* (2013.01); *A47L 15/0013* (2013.01); *A47L 15/4251* (2013.01); *A47L 15/483* (2013.01); *A47L 2501/10* (2013.01)

(58) Field of Classification Search

CPC ..... A47L 15/488

See application file for complete search history.

(56) References Cited

U.S. PATENT DOCUMENTS

| | | | | |
|---|---|---|---|---|
| 3,026,628 | A | 3/1962 | Berger, Sr. et al. | |
| 3,193,340 | A | 5/1964 | Braden | |
| 4,247,158 | A | 1/1981 | Quayle | |
| 8,696,824 | B2 | 4/2014 | Jadhav et al. | |
| 9,107,562 | B2 | 8/2015 | Haltmayer et al. | |
| 2005/0274036 | A1* | 12/2005 | Osvatic | A47L 15/488 34/201 |
| 2006/0022115 | A1* | 2/2006 | Byren | F41H 13/005 250/201.9 |
| 2016/0022115 | A1* | 1/2016 | Vallejo Noriega | A47L 15/488 34/572 |

(Continued)

FOREIGN PATENT DOCUMENTS

| | | |
|---|---|---|
| CN | 2539481 Y | 3/2003 |
| CN | 205006844 U | 2/2016 |

(Continued)

*Primary Examiner* — Jason Y Ko

(74) *Attorney, Agent, or Firm* — Alston & Bird LLP

(57) ABSTRACT

An apparatus for removing moisture as liquid from moisture-laden air in an appliance is provided. The apparatus includes a body that defines a channel extending from a first position to a second position and a serpentine flow path between the first position and the second position that operates to redirect the moisture-laden air to remove the liquid from the moisture-laden air. The body includes an opening at the serpentine flow path that is closed when the apparatus is secured to the wall of the appliance. In operation, the body cooperates with the wall to cause the moisture-laden air entering the channel at the first position through an inlet opening in the wall to pass into the serpentine flow path to remove the liquid from the moisture-laden air before the liquid exits the channel at the second position through an outlet opening in the wall.

24 Claims, 10 Drawing Sheets

(56) References Cited

U.S. PATENT DOCUMENTS

| | | | |
|---|---|---|---|
| 2017/0196431 | A1 | 7/2017 | Hong et al. |
| 2017/0290489 | A1 | 10/2017 | Noriega et al. |
| 2017/0325654 | A1 | 11/2017 | Doppelbauer et al. |
| 2018/0146836 | A1 | 5/2018 | Noriega et al. |

FOREIGN PATENT DOCUMENTS

| | | | |
|---|---|---|---|
| CN | 105996949 | A | 10/2016 |
| DE | 3538305 | A1 | 4/1987 |
| DE | 3930796 | A1 | 3/1991 |
| EP | 3213666 | A1 | 9/2017 |
| FR | 2491319 | A1 | 4/1982 |

* cited by examiner

APPLIANCE DRYING DUCT

FIELD OF THE INVENTION

Embodiments of the present invention relate generally to appliances and, in some embodiments, to dishwashers, dishwasher drying systems, and associated drying devices.

BACKGROUND

Households have come to rely upon dishwashers and other related appliances to perform effective clean, wash, rinse, and dry cycles. By way of example, a dishwasher may employ a tub defining a washing chamber therein with various racks to support dishware during a washing cycle, and, during the washing cycle, may dispense washing fluid in order to clean the dishware within the dishwasher. In some dishwashers, a drying cycle may also be used following the rinsing cycle in order to dry the dishware. However, traditional dishwashers may not provide for sufficiently consistent and uniform drying of the washing chamber or dishware, resulting in an increased likelihood of fluid residue build-up, susceptibility to mold, or any other hazard prevalent in humid environments. Other appliances requiring drying may be similarly deficient.

As such, there is a need for effective drying systems and associated drying devices that provide improved drying efficiency and effectiveness while maintaining a compact size required by many appliances. Applicant has identified a number of other deficiencies and problems associated with conventional dishwashers, drying systems, and other associated devices and methods. Through applied effort, ingenuity, and innovation, many of these identified problems have been solved by developing solutions that are included in embodiments of the present invention, many examples of which are described in detail herein.

BRIEF SUMMARY

Embodiments of the present invention address the above by providing an apparatus for removing moisture as liquid from moisture-laden air in an appliance. Example embodiments of such an apparatus may include a body including at least one elongate wall section. The body may further define a channel extending from a first position to a second position, and the channel may include a serpentine flow path between the first position and the second position. The serpentine flow path may redirect the moisture-laden air to remove at least some moisture as liquid from the moisture-laden air. The body may further define an opening defined at least at the serpentine flow path. The body may be secured to a wall of a tub of an appliance such that the opening in the body is at least partially closed by the wall of the tub at the serpentine flow path. The channel may also be at least partially bounded by the wall of the tub. In operation, the body may cooperate with the wall to cause the moisture-laden air entering the channel at the first position through an inlet opening in the wall to pass into the serpentine flow path to remove the at least some moisture as the liquid from the moisture-laden air before the liquid exits the channel at the second position through an outlet opening in the wall.

In some embodiments, the apparatus may further include a nozzle projection cap at the first position configured to extend up to or through the inlet opening in the wall of the tub of the appliance.

In other embodiments, the body may include a plurality of projections oriented in alternating directions that define the serpentine flow path. In such an embodiment, the plurality of projections may be configured to facilitate removal of the at least some moisture from the moisture-laden air received therein.

In some cases, the body may include a peripheral sealing surface defined along a perimeter of the opening and connected to one or more of the at least one elongate wall section. The peripheral sealing surface may prevent air in the serpentine flow path from escaping between the body and the wall at the perimeter of the opening. In such an embodiment, a gasket may be disposed along the peripheral sealing surface such that the gasket is configured to create a seal between the peripheral sealing surface and the wall of the tub of the appliance.

In some embodiments, the opening may extend from the first position to the second position such that the channel is configured to be at least partially bounded by the wall of the tub of the appliance continuously from the inlet opening at the first position to the outlet opening at the second position. In some other embodiments, the apparatus may include one or more attachment elements configured to secure the body to the washing tub.

In some further embodiments, the body may define one or more exhaust vents configured to allow air to vent to an ambient environment. In such an embodiment, the one or more exhaust vents may be defined in one or more of the at least one elongate wall between the serpentine flow path and the second position.

Embodiments of the apparatus may also be formed as a single, integral piece. In some embodiments of the apparatus, the at least one wall includes at least two elongate walls collectively forming a contiguous inner surface of the body. In such an embodiment, the contiguous inner surface may be at least partially curved.

In some further embodiments, the body may define an expansion chamber in the channel surrounding the first position. In some cases, the body may further define a lower trough in the channel at the second position and configured to direct the liquid to the outlet opening.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
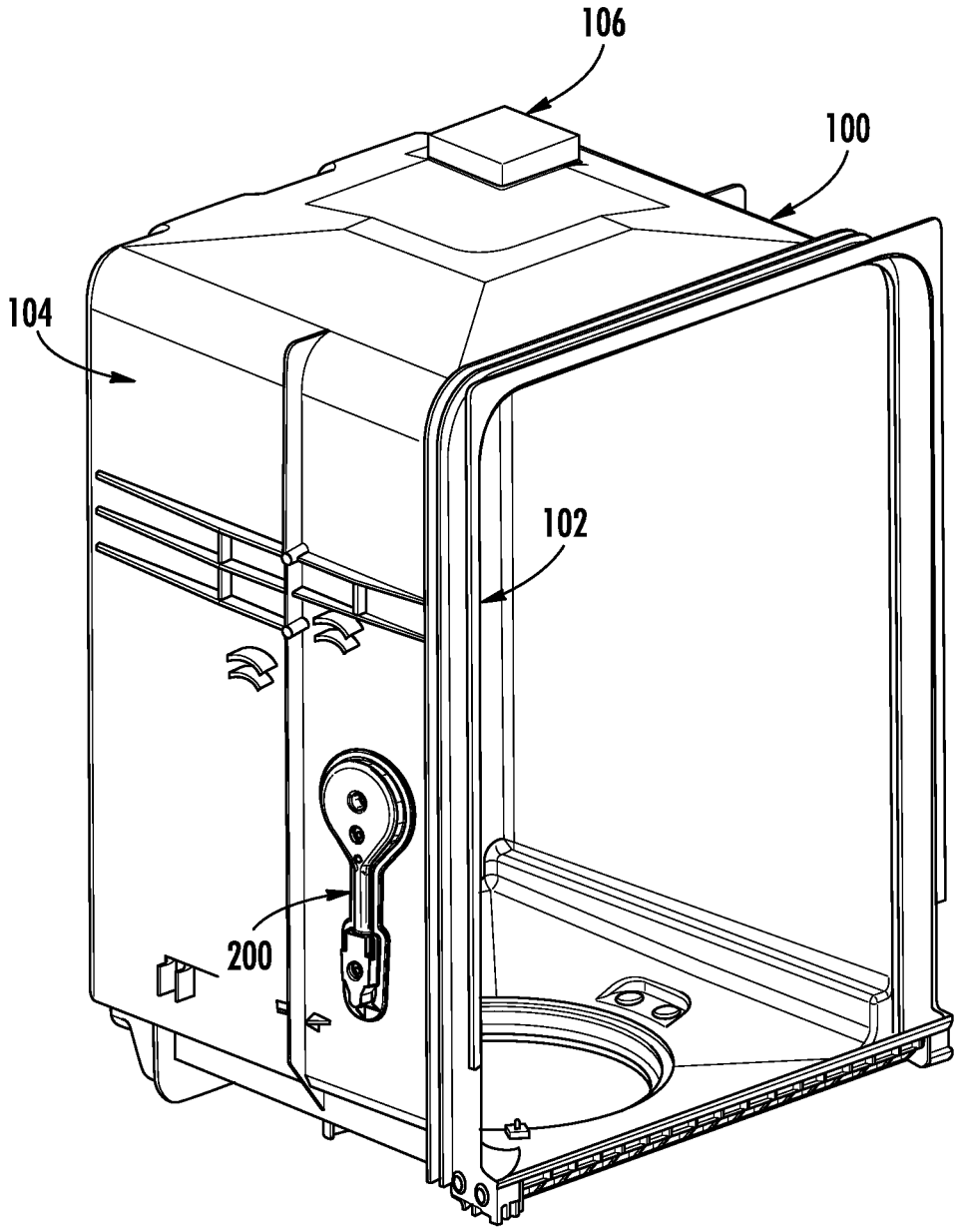
FIG. 1 illustrates a perspective view of a tub and drying duct suitable for use with various embodiments described herein.

The present inventions now will be described more fully hereinafter with reference to the accompanying drawings, in which some, but not all embodiments of the invention or inventions are shown. Indeed, these inventions may be embodied in many different forms and should not be construed as limited to the embodiments set forth herein; rather, these embodiments are provided so that this disclosure will satisfy applicable legal requirements. The terms "illustrative," "example," and "exemplary" are used to be examples with no indication of quality level. As used herein, the terms "approximately," "generally," and "substantially" refer to within manufacturing and/or engineering design tolerances for the corresponding materials and/or elements as would be understood by the person of ordinary skill in the art, unless otherwise indicated.

As used herein, terms such as "front," "rear," "top," etc. are used for explanatory purposes in the examples provided below to describe the relative position of certain components or portions of components, and need not describe the absolute position of any component relative to the earth at all points in time. For example, one component being described as a "top" or "upper" component may be above a "bottom" or "lower" component in an operational position, but the "top" or "upper" component may be below another "lower" component elsewhere in the appliance or may be below the "lower" or "bottom" component during manufacturing, shipping, or installation.

As used herein, terms such as "channel," "conduit," "fluid channel," and the like may be used interchangeably to encompass any structure through which a fluid may flow. In particular, any configuration of horizontal walls, vertical vanes, or any structure which directs, redirects, at least partially encloses, or supports fluid flow is contemplated by the aforementioned terms in embodiments of the present disclosure. Additionally, as used herein, each of "water," "liquid," "fluid," "wash fluid," "rinse water," "cleaning fluid," "washing fluid," and the like refers to any liquid or fluid used in dishwashers or other appliances. Similarly, reference herein may be made to moisture-laden air in which at least a portion of the air within the described apparatus (e.g., drying duct) includes a suspended fluid (e.g., water vapor, moisture, steam, or the like). At various locations within the devices described herein, however, the air contained within the apparatus may be at any number of stages (e.g., from fully saturated air to substantially dry air lacking any moisture) and, therefore, "moisture-laden air" and/or "air" should not be read to limit the devices of the present disclosure to any particular quantity of suspended moisture or humidity.

As used herein, reference is made to a "drying duct" attached to a wall of a tub. The present disclosure, however, contemplates that the apparatus of the present disclosure may only be configured to operate as a drying duct in an instance in which the apparatus is attached to the wall of the tub (e.g., the apparatus is open on one side). For the sake of consistency and clarity, however, the apparatus may be referred to as a drying duct in any operational or transitory configuration, regardless of whether moisture removal (e.g., condensation, precipitation, or other separation of liquids or water vapor from air) is occurring at a particular time. Additionally, reference herein is made to the apparatus (e.g., drying duct) attached to an outer wall surface of a tub in a dishwasher. However, the present disclosure contemplates that the apparatuses and devices described herein (e.g., drying ducts) may be equally applicable to other appliances (e.g., washing machines, refrigerators, or the like) wherein removing moisture and/or reducing fluid residue is advantageous. Like numbers refer to like elements throughout.

With reference to FIGS. 1-3B, an example of a tub 100 of an appliance capable of implementing various embodiments of the present invention is illustrated. The depicted tub 100 includes a plurality of walls 103 (e.g., three side walls, a door, a top, and a sump), form a washing chamber 101 in which dishes, utensils, and other dishware may be placed for washing. The plurality of walls 103 may define an inner wall surface 102 configured to receive various elements for performing washing operations (e.g., dishracks, fluid conduits, or the like) and an outer wall surface 104 configured to engage a drying duct 200. In some embodiments, the outer wall surface 104 may form the outermost surface (e.g., contacting an ambient environment) of the dishwasher.

During a washing cycle, the washing chamber 101 of the tub 100 is supplied with washing fluid via various jets, nozzles, wash arms, or the like in order to clean dishware supported within the washing chamber 101. Following the washing cycle, the liquid washing fluid may be removed from the tub 100 via one or more drain pipes, drain pumps, or the like. Following a washing cycle, the dishware contained within the washing chamber 101, the inner wall surface 102 of the tub 100, and/or the air contained within the tub 100 may include fluid vapor, moisture, and residue. In order to sufficiently dry the dishware and the interior of the washing chamber 101, a drying device (e.g., drying duct 200 described hereafter) may be used to remove moisture from the air within the washing chamber as liquid and exhaust drier air while directing removed liquid from the moisture laden air back to the sump of the tub 100 for draining, storage, or circulation (e.g., via one or more pumps connected to the sump).

Drying ducts positioned in the door of the dishwasher may be limited in their discharge directions for aesthetic reasons, and because electronics are positioned in the door, condensation around the electronics may shorten their lifespan or cause shorting. The depicted drying duct 200 in FIGS. 1-3B is arranged on a non-door wall 103 of the appliance tub 101 spaced from the door, and the drying duct 200 vents drier air into the cabinet surrounding the appliance. In some embodiments, the drying duct may be positioned on or in the door.

Figure 2:
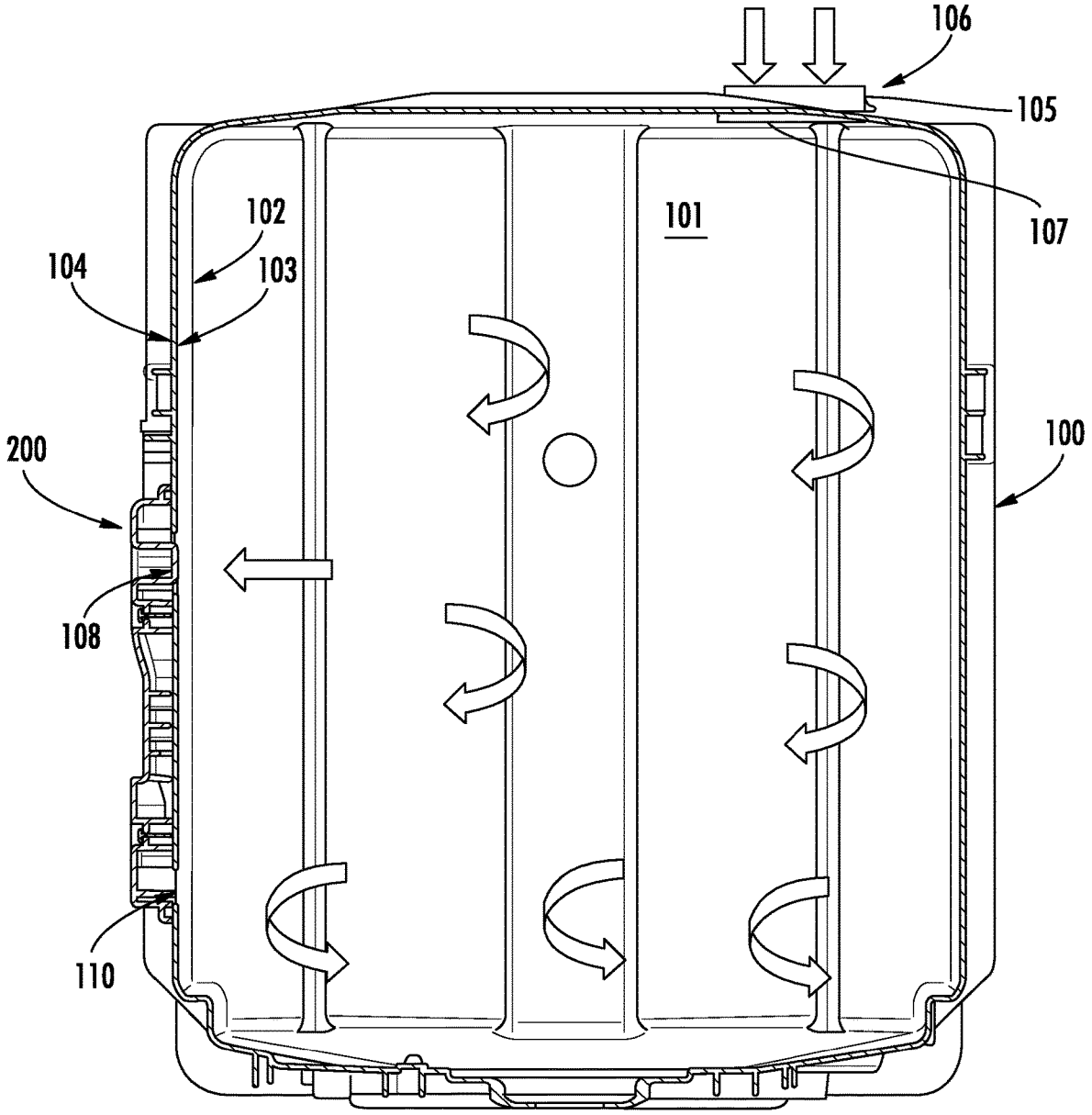
FIG. 2 illustrates a cross-sectional view of the tub and drying duct of FIG. 1.

With continued reference to FIGS. 1-3B, the washing chamber 101 may also include a vent assembly 106 to provide fluid communication between the interior of the washing chamber 101 and an ambient environment in order to facilitate such a drying process. As illustrated in FIG. 2, the vent assembly 106 may include a fan 105 and a vent opening 107 in the tub that is configured to direct air into the washing chamber 101 to create a positive pressure in the washing chamber (e.g., the pressure within the washing chamber is greater than the pressure in the ambient environment at least when the fan is running). The positive pressure may cause the air within the washing chamber 101 to be driven through any available openings in the tub 100 to attempt to equalize with the ambient environment. In this way, air (e.g., warm humid air created by a washing cycle) is directed to an opening in the wall 103 of the tub 100 (e.g., inlet opening 108) and into a drying duct 200 at a first position as described hereafter. At least a portion of the fluid suspended in the humid, moisture-laden air that is directed into the drying duct 200 via the inlet opening 108 may be at least partially removed and returned to the washing chamber 101 (e.g., into the sump at the lower end of the tub 100) in liquid form via the outlet opening 110 in the wall 103 of the tub at the second position as described hereafter. In order to promote entrance of the moisture-laden air into the drying duct 200 via the inlet opening 108, in some embodiments, the inlet opening 108 may be dimensioned (e.g., sized and shaped) to be larger than the outlet opening 110. As illustrated in FIG. 1 and described more fully hereafter with reference to FIGS. 4-9B, a drying duct 200 may be attached or otherwise secured to one or more exterior walls 103 of the washing chamber 101.

Figure 3B:
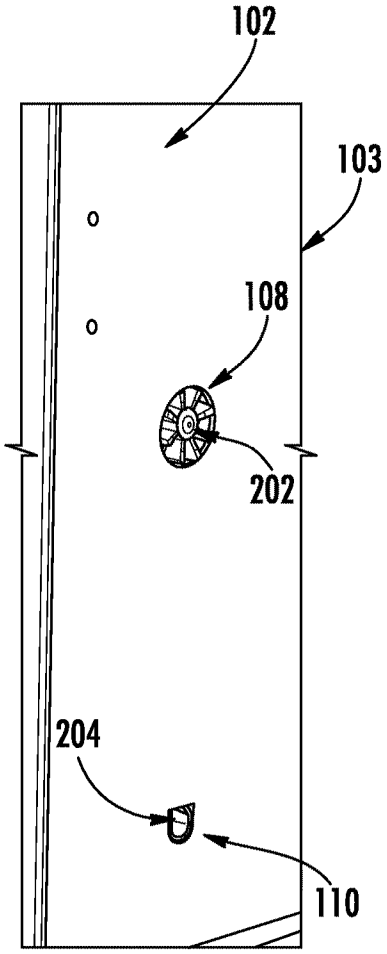
FIG. 3B illustrates an interior perspective view of the tub and drying duct of FIG. 1.
Figure 3A:
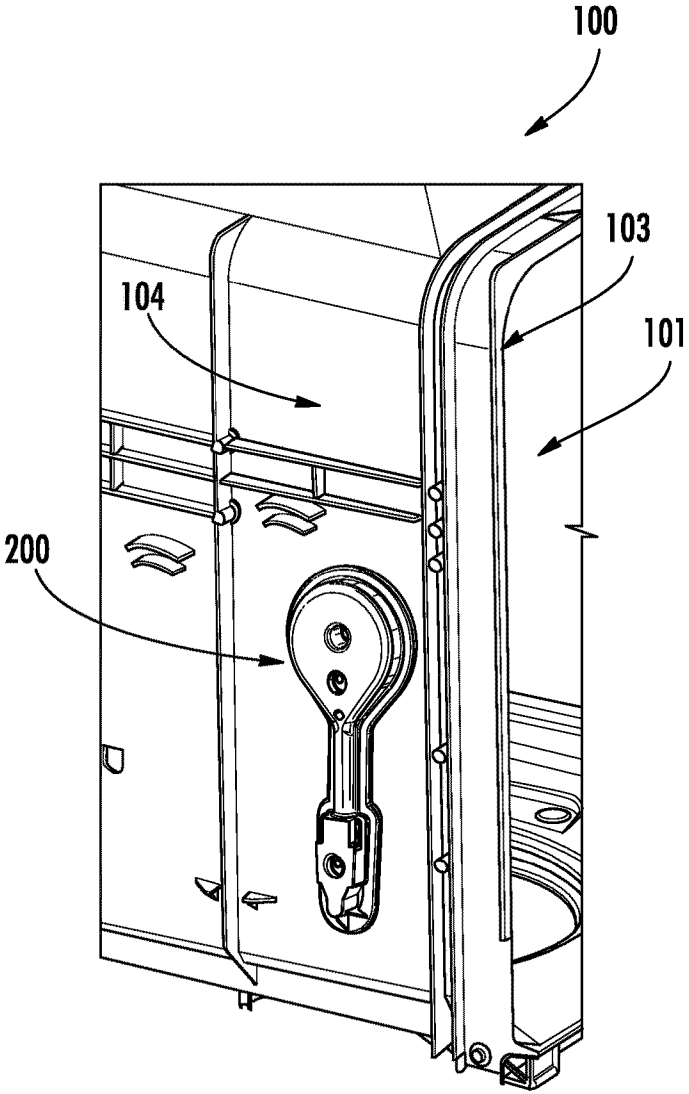
FIG. 3A illustrates an exterior perspective view of the tub and drying duct of FIG. 1.
Figure 4:
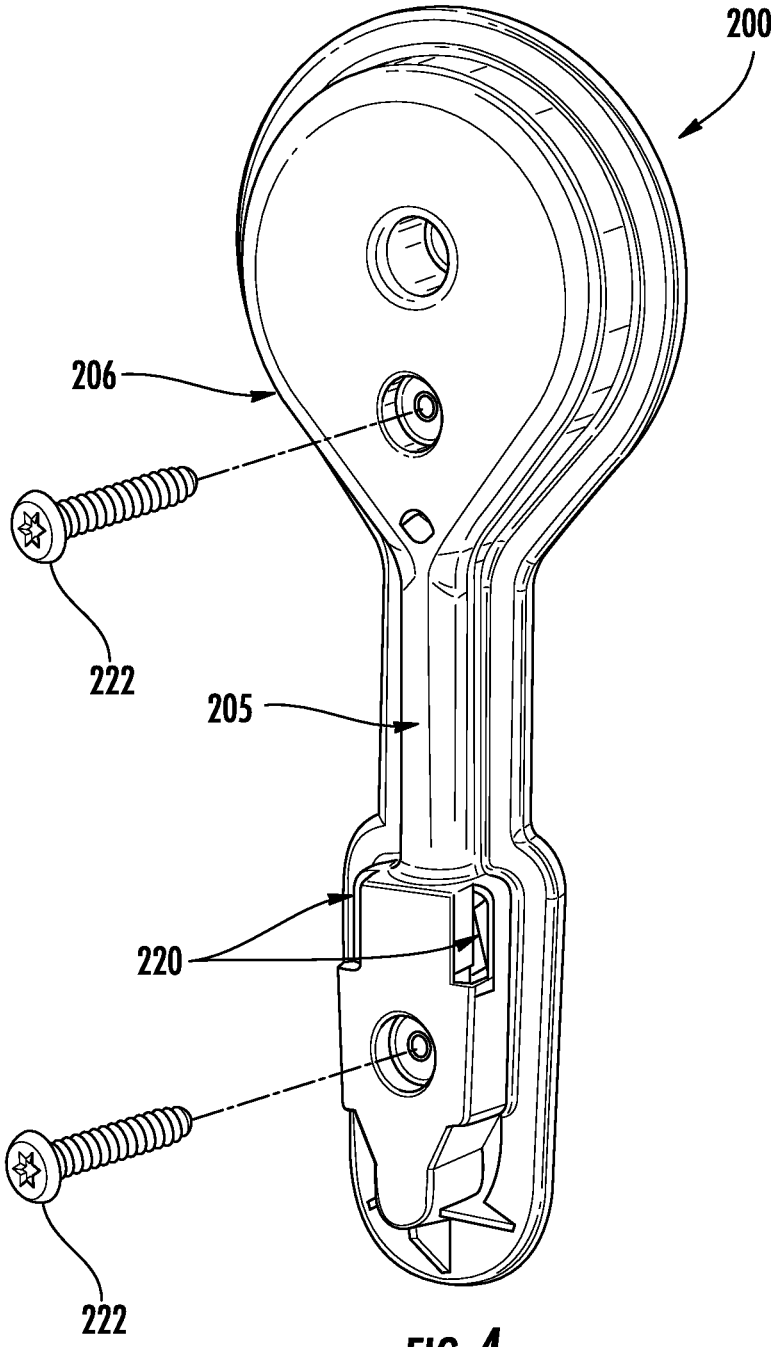
FIG. 4 illustrates an exterior surface of a drying duct, in accordance with an example embodiment.
Figure 5:
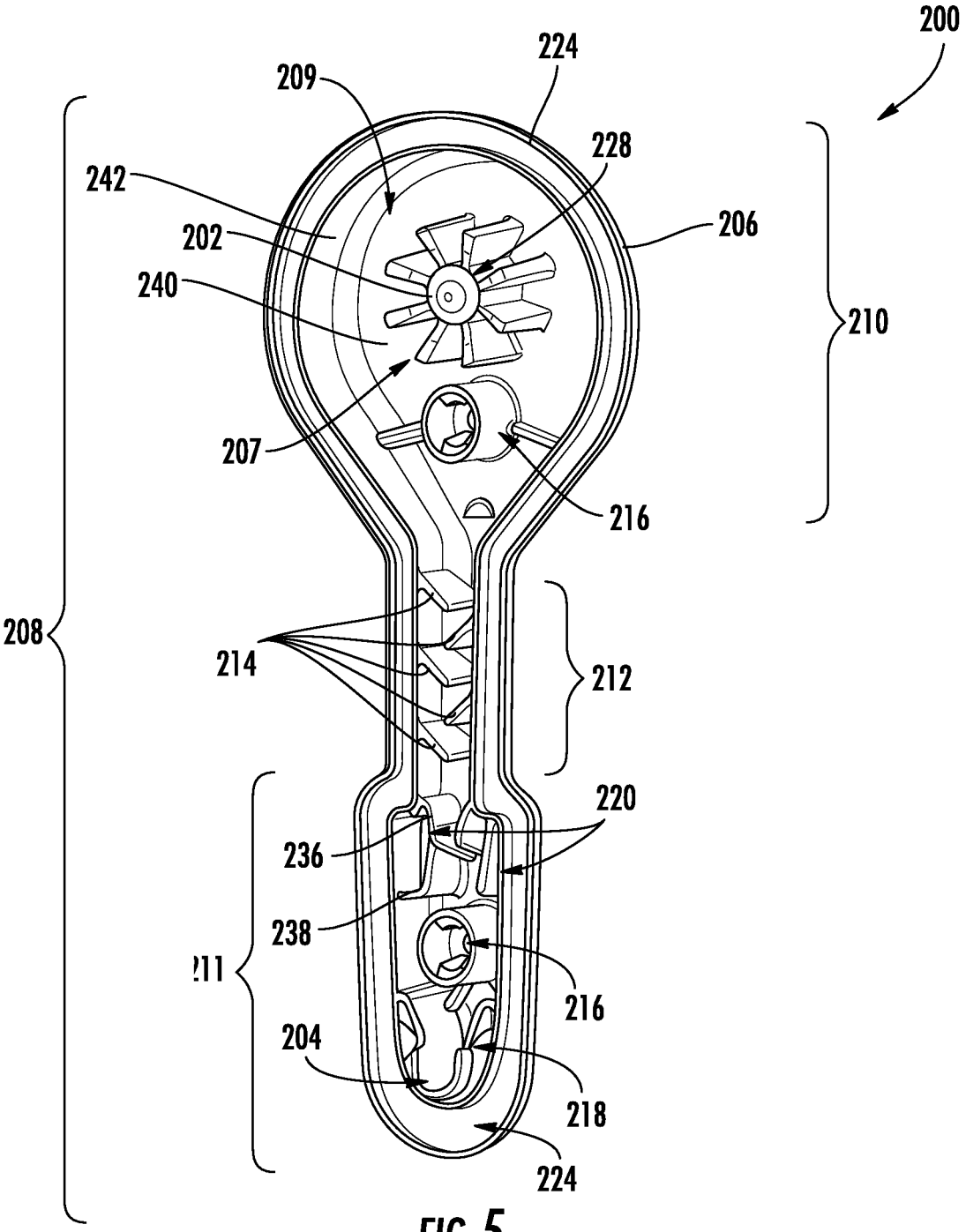
FIG. 5 illustrates a channel defined by the drying duct of FIG. 4, in accordance with an example embodiment.

With reference to FIGS. 4-5, a drying duct 200 is illustrated according to an example embodiment. In the depicted embodiment, the body 205 of the drying duct 200 defines an exterior surface 206, a channel 208, an opening 209, and a peripheral sealing surface 224. In operation in which the body 205 of the drying duct 200 is secured to the outer wall surface 104 (e.g., shown in FIGS. 1-3B), and the exterior surface 206 contacts the ambient environment while the channel 208 is in fluid communication with both the washing chamber 101 and the ambient environment (e.g., via one or more vents 220). In such an embodiment as shown in FIG. 5, the channel 208 and opening 209 of the drying duct 200 are defined opposite the exterior surface 206. As shown, the channel 208 extends from a first position (e.g., a first position 202 described hereafter at FIG. 6) to a second position (e.g., a second position 204 described hereafter at FIG. 8) within the body 205 and along the outer wall surface 104. In particular, the channel 208 is defined by the body 205 of the drying duct 200 as a recessed portion (e.g., cavity, void, depression, or the like) of the body that is at least partially open when not attached to the tub 100 (e.g., opening 209). Said differently, the channel 208, in an instance in which the drying duct 200 is secured to the outer wall surface 104, includes the area extending between the outer wall surface 104 and the exterior surface 206 (e.g., the area extending from the plane defined by the outer wall surface 204 to the exterior surface 206), such that the outer wall surface 104 and body 205 each bound a portion of the channel in the assembled position shown in FIGS. 2-3B.

With reference to FIG. 5, the drying duct 200 includes an opening 209 disposed at least at the serpentine flow path (e.g., serpentine flow path 212 described hereafter at FIG. 7) such that the outer wall surface 104 of the wall 103 of the washing chamber 101 operates to close the opening 209 to form the drying duct 200. As illustrated, however, the opening 209 extends vertically at least from a first position 202 on the body 205 to a second position 204 on the body such that the channel 208 is configured to be at least partially bounded by the outer wall surface 104 continuously from the first position 202 to the second position 204. While illustrated and described herein with reference to an opening 209 defined as a plane that extends along the length of the duct 200 from at least the first position 202 to the second position 204 (e.g., substantially the entire length of the drying duct 200), the present disclosure contemplates that the opening 209 may extend any length of the channel 208 and may be bounded by a peripheral sealing surface 224. In the depicted embodiment, the drying duct 200 includes the peripheral sealing surface 224 defined along a perimeter of the opening 209. The peripheral sealing surface 224 is configured to prevent air within the chamber 208 from escaping between the body 205 and the outer wall surface 104 (e.g., via the opening 209). In some embodiments, the opening 209 may alternately be closed by an additional wall (not shown) attached to (e.g., via seal, glue, or welding) or integral with the drying duct 200, such that the additional wall abuts the outer wall surface 104 in an operational position.

The drying duct 200 may include an inner surface 207 that defines the channel 208 and extends from at least the first position 202 to the second position 204 including the expansion chamber 210, the serpentine flow path 212, and the release chamber 211. The inner surface 207 may be made up of one or more elongate wall sections (e.g., rear wall 240 and/or peripheral side wall 242). In some embodiments, two or more elongate wall sections may be discrete sections of a body wall joined at a seam or angle, or the elongate wall sections may be portions of the same wall. For example, the depicted rear wall 240 and peripheral side wall 242 combine to form a semi-circular cross section at the serpentine flow path. In some embodiments, at least a portion of the rear wall 240 may be perpendicular to at least a portion of the peripheral side wall 242. In some embodiments, the peripheral sealing surface 224 may be attached to the peripheral side wall 242. In some embodiments, the channel may be formed by a single curved or bent wall, and in some embodiments, the channel may be formed by multiple elongated wall sections connected at a bend, curve, or angle.

With reference to FIGS. 4-5, in some embodiments, the drying duct 200 may be formed as a single, integral piece (e.g., member, element, structure, etc.) such that each of the features and elements of the drying duct 200 described above and hereafter are defined by the body 205 of the drying duct. In some embodiments, the body 205 of the drying duct 200 may be attached to the outer wall surface 104 as a single member so as to ease assembly of the devices herein and to further operate to retrofit appliances that previously failed to provide for such drying devices. In some embodiments, the single-piece drying duct 200 may be attached to the outer wall surface 104 with one or more attachment elements 222 (e.g., screws, rivets, adhesive, welding, nails, etc.) through one or more alignment elements 216. While illustrated herein as a single, integral piece, however, the present disclosure contemplates that in some embodiments, the drying duct 200 may be formed as separate, modular components that may be individually attached to the outer wall surface 104. In some embodiments, the drying duct 200 may be molded as a single piece of material.

In some embodiments, the drying duct 200 may define a length from end to end along the axis extending between the first position 202 and the second position 204. In some embodiments, the length may be shorter than the height of the tub 100. In some embodiments, the length may be shorter than the wall 103 of the tub 100. In some embodiments, the length may be less than 15 inches to fit between two or more ribs formed on the wall 103 of the tub 100. In some embodiments, the length may be less than 12 inches to fit between two or more ribs formed on the wall 103 of the tub 100.

Figure 6:
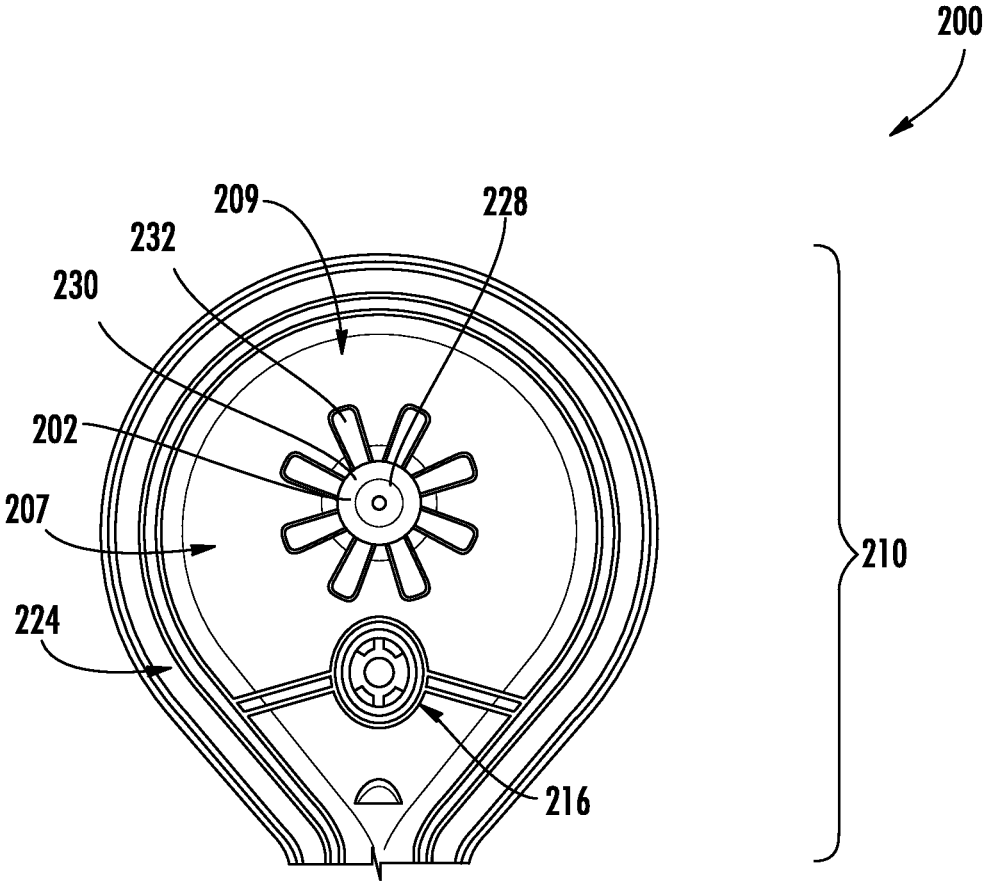
FIG. 6 illustrates a partial perspective view of the channel of FIG. 5 at a first position, in accordance with an example embodiment.

With reference to FIG. 6, a portion of the channel 208 corresponding to the first position 202 is illustrated. As shown, the first position 202 of the channel 208 corresponds to the portion of the drying duct 200 configured to align with be located at the inlet opening 108 (e.g., an opening in the wall 103 of the tub 100). As shown in FIG. 6, the channel 208 may define a nozzle projection cap 228 at the first position 202 configured to extend from an inner surface of the body 205 within the channel 208 up to or through the inlet opening 108 in the wall 103 of the washing chamber 101 (e.g., as shown in FIG. 3B). In some embodiments, the nozzle projection cap (e.g., the first position 202) may extend up to the inner wall surface 102 such that the nozzle projection cap and the inner wall surface 102 are coplanar. In other embodiments (not shown), the nozzle projection cap at the first position 202 may extend through the inlet opening 108 such that at least a portion of the nozzle projection cap extends beyond the inner wall surface 102 into the washing chamber 101. The nozzle projection cap 228 at the first position 202 may operate to limit the amount of liquid water that enters the drying duct 200 (e.g., washing fluid spray during a washing cycle) by blocking a portion of the inlet opening 108.

With continued reference to FIG. 6, the drying duct 200 includes an expansion chamber 210 in the channel 208 surrounding the first position 202. As shown, the expansion chamber refers to a substantially circular portion of the channel 208 (e.g., the interior of the drying duct 200) that surrounds the nozzle projection cap at the first position 202, and which portion defines a wider portion of the channel 208 that is then constricted to a narrower diameter at a serpentine flow path 212 (shown in FIG. 7).

In operation in which the drying duct 200 is secured to the outer wall surface 104 of the tub 100, moisture-laden air may enter the drying duct 200 via the inlet opening 108 (shown in FIG. 2) at the first position 202. As the moisture-laden air enters the drying duct 200 at the first position 202 (e.g., as partially limited by the nozzle projection cap 228 in some embodiments), the moisture-laden air may pass through the relatively narrow gaps between the nozzle projection cap 228 and inlet opening 108 and may thereafter expand into the channel 208. The expansion chamber 210 may define this portion of the channel 208 surrounding the nozzle projection cap at the first position 202 in which the expansion occurs. Furthermore, the expansion chamber 210 extends at least from the first position 202 to the serpentine flow path 212 described more fully hereafter with reference to FIG. 7. While the drying duct 200 may be dimensioned (e.g., sized and shaped) in order to optimize the amount of moisture removed from the air within the washing chamber 101, in some embodiments, the drying duct 200 may be further dimensioned with consideration to the size of the appliance as a whole. Said differently, in some embodiments, the drying duct 200 may be dimensioned (e.g., sized and shaped) and/or located such that the size of the appliance is maintained (e.g., the overall size of the appliance does not increase).

Figure 7:
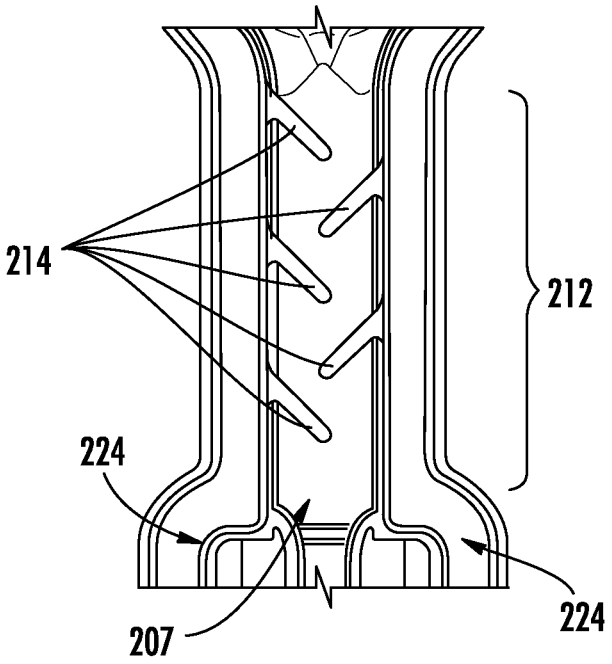
FIG. 7 illustrates a partial perspective view of the serpentine flow path of the channel of FIG. 5, in accordance with an example embodiment.

With reference to FIG. 7, a portion of the channel 208 corresponding to the serpentine flow path 212 is illustrated. The serpentine flow path 212 may define a portion of the channel 208 between the first position 202 and the second position 204 configured to redirect the moisture-laden air across one or more condensing surfaces to condense or otherwise remove the liquid from the moisture-laden air. The body 205 of the drying duct 200, in some embodiments, includes a plurality of projections 214 that define the serpentine flow path 212 therebetween. As shown, the plurality of projections 214 may be defined as walls projecting into the channel 208 from the body 205. The projections 214 may be oriented in alternating directions from opposite sides of the channel 208 to facilitate removal of the moisture-laden air received in the channel. In some embodiments, each projection in the plurality of projections 214 may extend from the body 205 (e.g., a wall of the channel 208) in an inward and downward direction. Said differently, each projection may contact the inner surface 207 of the channel 208 proximate the peripheral sealing surface 224 at a first end and may extend away from the peripheral sealing surface 224 and terminate at a second end, where the second end is closer to the second position (e.g., and outlet opening 110) than the first end of the projection. While illustrated in FIG. 7 as five (5) alternating projections, the present disclosure contemplates that any number of projections having any orientation may be used so long as the moisture-laden air received by the serpentine flow path 212 may redirect the moisture-laden air. For example, in some embodiments, one, two, three, four, five, six, seven, eight, nine, or ten projections may be used. Similarly, in some embodiments, the body 205 of the drying duct 200 may curve and bend to form the serpentine flow path 212 or the wall of the channel 208 within the body may curve and bend to form the serpentine flow path 212 to form an alternating, serpentine path as shown by the projections 214 in FIG. 7.

In operation, moisture-laden air that enters the drying duct 200 at the first position 202 via the inlet opening 108 expands (e.g., via the expansion chamber 210) and is directed into the serpentine flow path 212. As the moisture-laden air is redirected between each of the alternating projections 214 or via the curvature of the inner surface 207 of the channel 208, liquid suspended within the fluid may condense or otherwise be removed from the air within the channel 208. The serpentine flow path 212 may operate to increase the distance traveled by the moisture-laden air between the first position 202 and the second position 204 of the drying duct 200. By increasing this travel distance, the temperature of the air may decrease to or below the dew point (e.g., the point beneath which suspended liquid vapor condenses to form a fluid) and have greater surface area on which to condense. By providing contact surfaces (e.g., the plurality of projections 214 and the inner surface 207 of the body 205) as the temperature of the moisture-laden air decreases through the dew point, the liquid suspended in the moisture-laden air may condense on the surfaces. This condensed liquid may travel through the serpentine flow path 212 for exiting the drying duct 200 into the washing chamber 101 at the second position 204 (e.g., described hereafter with reference to FIG. 8) via the condensing outlet 110 in the tub 100. In some instances, moisture (in either liquid or vapor form) entrained in the air may be mechanically removed via the serpentine turns of the serpentine flow path 212 whereby air is able to turn sharply around the turns but the liquid instead contacts the inner surface 207 of the body and runs down by gravity until the liquid is discharged into the washing chamber 101. As used herein, the terms "removing," "separating," "condensing," or "drying" moisture from moisture laden air may refer interchangeably to any process by which moisture is removed from moisture-laden air.

Figure 8:
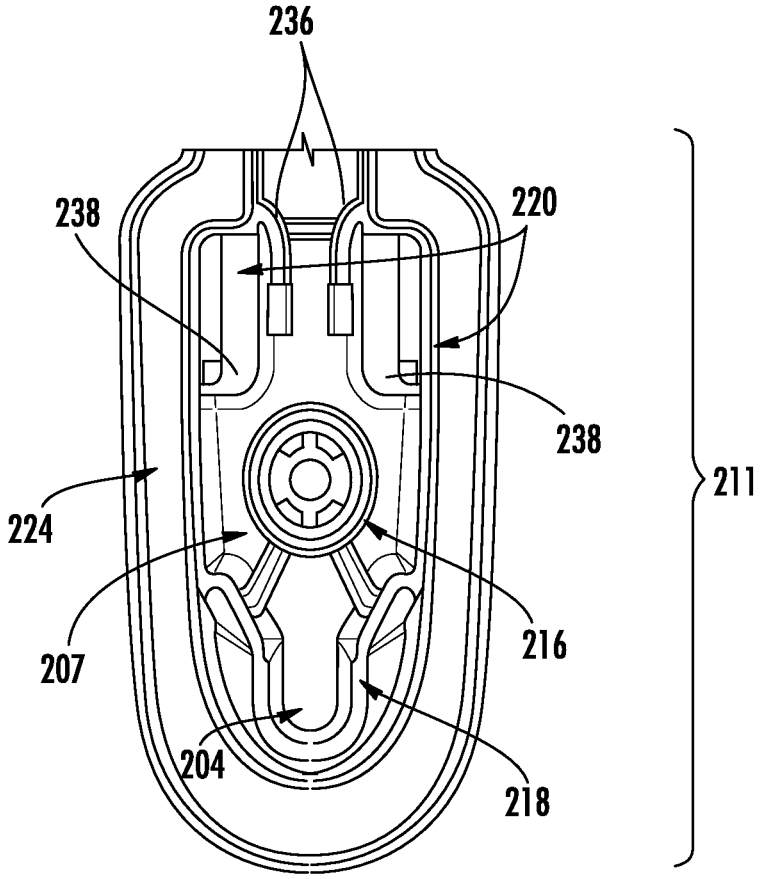
FIG. 8 illustrates a partial perspective view of the channel of FIG. 5 at a second position, in accordance with an example embodiment.

With reference to FIG. 8, a release chamber 211 defining a portion of the channel 208 at the second position 204 is illustrated. As shown, the second position 204 of the channel 208 may correspond to the portion of the drying duct 200 located at the outlet opening 110 of the tub 100 in an assembled position. In some embodiments, the second position 204 of the channel 208 is configured as part of the same continuous body 205 as the opening 209 (e.g., and the first position 202 described above). As shown in FIG. 8, the channel 208 may define a lower trough 218 at the second position 204 configured to direct the removed liquid to the outlet opening 110 in the wall 103 of the tub 100 (e.g., as shown in FIG. 3B). In some embodiments, the lower trough 218 at the second position 204 may extend up to the inner wall surface 102 such that an edge of the lower trough 218 and the inner wall surface 102 are at least coplanar to discharge any liquid water back into the washing chamber 101. In some embodiments, the lower trough 218 may extend through the outlet opening 110 such that at least a portion of the lower trough 218 extends beyond the inner wall surface 102 into the washing chamber 101. In some embodiments, the lower trough 218 may include a semi-circular or U-shaped distal end to discharge the fluid into the washing chamber 101. The lower trough 218 may be angled downward in the operational position to direct the removed liquid back into the washing chamber 101. In some embodiments, the distal end of the lower trough 218 may have substantially the same cross sectional shape as the outlet opening 110 to align the drying duct 200 with the outlet opening 110. The lower trough 218 at the second position 204 may operate to direct the removed liquid into the washing chamber 101.

With continued reference to the example embodiment of FIG. 8, the drying duct 200 may include one or more exhaust vents 220 for releasing dried air to the ambient environment. In the depicted embodiment, the one or more exhaust vents 220 are openings formed in the body 205 (e.g., from the channel 208 to the exterior surface 206) disposed at the release chamber 211. In some embodiments, the one or more exhaust vents 220 may be disposed between the serpentine flow path 212 and the second position 204. In some embodiments, the one or more exhaust vents may comprise two exhaust vents. The exhaust vents 220 may be located such that removed liquid from the serpentine flow path 212 is prevented from exiting the drying duct 200 via the exhaust vents 220. For example, in some embodiments, one or more dividing walls 236, 238 may be positioned between the fluid flow portion of the channel 208 and the exhaust vent 220 (e.g., the area between the dividing walls 236, 238 of the respective vents 220 shown in FIG. 8 through which liquid may pass after being separated from the moisture-laden air).

The dividing walls may prevent downward-flowing liquid from entering the exhaust vents 220 while still allowing dry air to flow out through the exhaust vents. With continued reference to FIG. 8, in some embodiments, each vent 220 may include an upper dividing wall 236 and a lower dividing wall 238 with a channel therebetween. The upper dividing walls 236 may be inward of the lower dividing walls 238 relative to a distal end of the serpentine flow path 212, such that the two dividing walls 236, 238 overlap to prevent downward flowing liquid from exiting through the vent 220. In operation, air from the serpentine flow path 212 may enter the lower end of the channel between respective dividing walls 236, 238 and travel upwards to and out the vent 220 while liquid water is prevented from traveling upwards by gravity. The ends of the dividing walls 236, 238 may be tapered or angled as shown in FIG. 5 to prevent liquid from exiting through the respective vents 220 while allowing the drier air to exhaust through the vent. In some embodiments, the one or more exhaust vents 220 may include two substantially rectangular openings located proximate the peripheral sealing surface 224.

While illustrated in FIG. 8 as two (2) exhaust vents 220 between the serpentine flow path 212 and the second position 204, the present disclosure contemplates that the drying duct 200 may include any number of exhaust vents 220 at any location downstream of the serpentine flow path 212 at any orientation so long as removed liquid is substantially prevented from exiting via the exhaust vents 220.

In an example operation, moisture-laden air that enters the serpentine flow path 212 is redirected between each of the plurality of alternating projections 214 (e.g., or via the curvature of the inner surface 207 of the chamber 208) such that liquid suspended within or disposed within the air may be removed and form as a liquid on the plurality of projections 214. This condensed liquid may enter the release chamber 211 downstream of the serpentine flow path 212 illustrated in FIG. 8. While the removed liquid exits the drying duct 200 at the second position 204, a portion of the remaining air exiting the serpentine flow path 212 may exit the drying duct 200 via the exhaust vents 220. As described above, the positioning of the exhaust vents 200 may be such that the liquid leaving the serpentine flow path 212 is directed to the second position 204 (e.g., the exhaust vents 220 are not in the fluid flow path of the release chamber 211). Through condensation or other removal means, the air that exits the drying duct 200 and the serpentine flow path 212 may contain less moisture than the air entering drying duct 200 and the serpentine path 212 (e.g., the moisture-laden air noted above). In some embodiments, the air may be partially dried to a satisfactory level before release to the ambient environment, such as to a saturation level that will not produce condensation at the temperature of the ambient environment (e.g., the dew point of the dried air may be less than the ambient temperature). In some embodiments, the dried air may or may not be fully unsaturated (e.g., the air may contain suspended fluid). The aforementioned positive pressure may cause the dried air (whether fully or partially unsaturated) to be discharged from the exhaust vents 220.

Figure 9B:
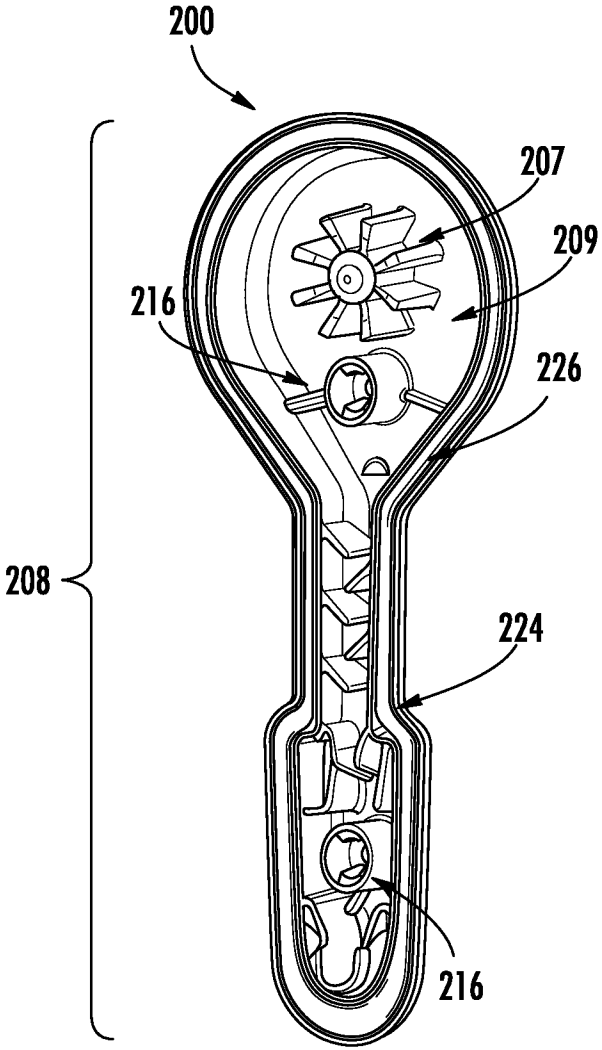
FIG. 9B illustrates a perspective view of a drying duct and gasket for sealing the drying duct to the outer wall surface of FIG. 9A.
Figure 9A:
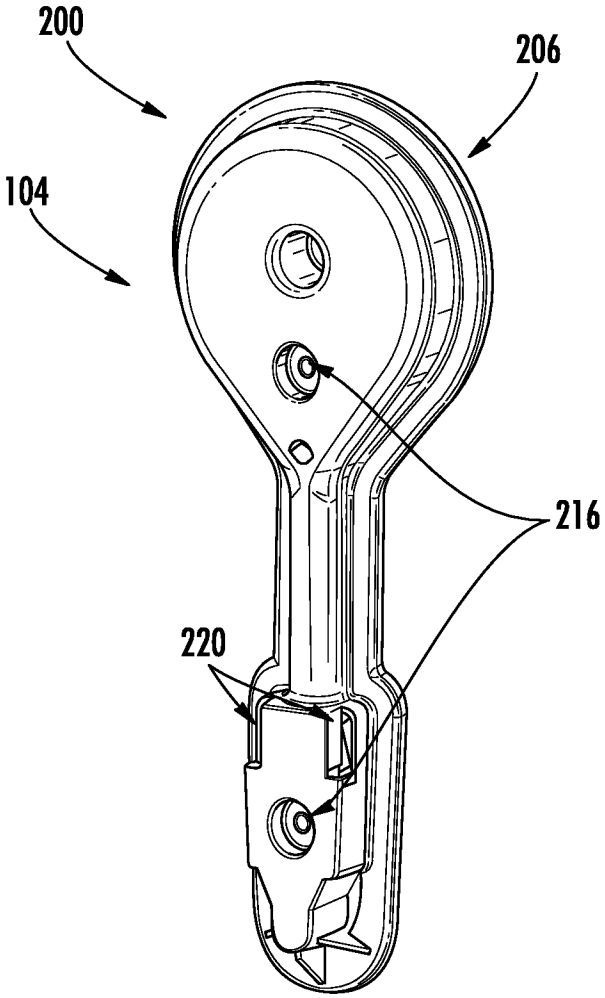
FIG. 9A illustrates a perspective view of a drying duct secured to the outer wall surface of a tub, in accordance with an example embodiment.

With reference to FIGS. 9A-9B, a perspective view of the drying duct 200 secured to the outer wall surface 104 of the tub 100 and a perspective view of a gasket 226 for cooperating with the sealing surface 224 to seal the drying duct 200 to the outer wall surface 104 are illustrated. As shown in FIG. 9B, the drying duct 200 may include one or more alignment elements 216 and associated attachment elements 222 (shown in FIG. 4) (e.g., screws, rivets, adhesive, welding, nails, etc.) for securing the drying duct 200 to the tub 100 for operation. The one or more alignment elements 216 may define protrusions extending within the channel 208 for mating with the outer wall surface 104 in order to align the first position 202 with the inlet opening 108 and the second position 204 with the outlet opening 110. By way of example, the outer wall surface 104 may define one or more holes for receiving the attachment elements 222.

In operation when the drying duct 200 is secured to the tub 100, the alignment elements 216 may surround the holes in the wall 103 of the tub 100 such that contact between moisture-laden air and/or liquid within the drying duct 200 and the attachment elements is precluded. Furthermore, the alignment elements 216 may be defined by the body of the drying duct 200 so as to properly position the drying duct 200 for operation. Said differently, by positioning the alignment elements 216 relative a corresponding feature of the tub 100 (e.g., a screw hole), the alignment elements 216 function to align the first position 202 with the inlet opening 108 and the second position 204 with the outlet opening 110.

In some embodiments, aligning the features of the drying duct with the inlet opening 108 and the outlet opening 110 will thereby align the alignment elements 216 with the corresponding feature of the tub 100 (e.g., a screw hole). For example, the radial projections 232 of the nozzle projection cap 228 may align with and rest within the inlet opening 108 such that the nozzle cap projection is centered in the inlet opening 108. The lower trough 218 may similarly align with and rest within the outlet opening 110 such that the lower trough is centered in the outlet opening 110. Once positioned, the alignment elements 216 may thereby also be in the proper location for attachment.

With reference to FIG. 9B, the drying duct 200 may further include a gasket 226 disposed along the peripheral sealing surface 224 (e.g., covered by the gasket 226). The gasket 226, in some embodiments, may be configured to create a seal between the peripheral sealing surface 224 and the outer wall surface 104 of the washing chamber 101. As shown, the gasket 226 and peripheral sealing surface 224 may encircle the opening 209 of the drying duct 200. In some embodiments, the peripheral sealing surface 224 and gasket 226 may encircle each of the features defined by the body of the drying duct 200 described above, such that the opening 209 is included within the periphery of the sealing surface 224 and gasket 226. Said differently, in the embodiment illustrated in FIG. 9B, the outer wall surface 104 of the tub 100 may bound the channel 208 continuously from the first position 202 to the second position 204 including the serpentine flow path 212

The embodiments of a drying duct 200 as described herein provide an improved removal of moisture from moisture-laden air (e.g., an improved drying process) without increasing the associated size requirements of the drying duct (e.g., while maintaining a smaller footprint than conventional devices). In addition, the material costs may be reduced by using the tub 100 as one boundary of the channel 208, and durability may be improved by having the entire duct 200 secured to the tub 100 rather than loose conduits and housings hanging from the appliance.

Figure 10C:
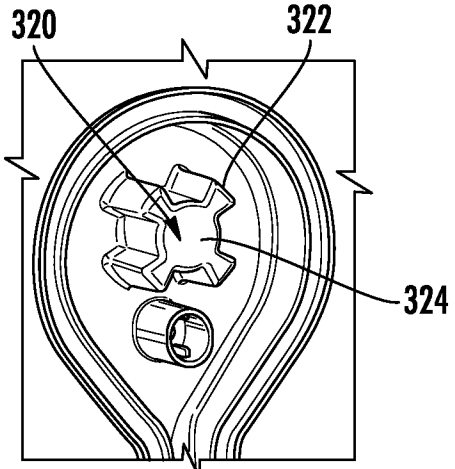
FIGS. 10A-10C illustrate several nozzle projection caps, in accordance with example embodiments.
Figure 10B:
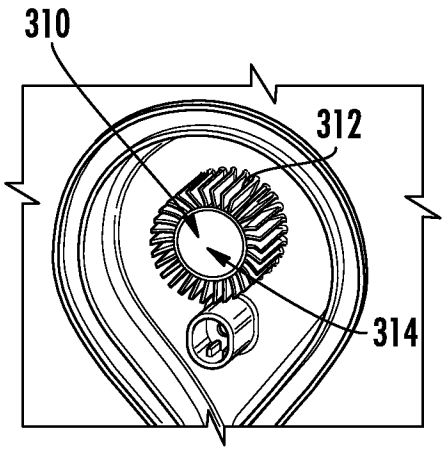
Figure 10A:
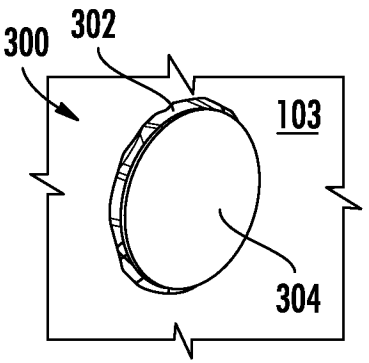

With reference to FIGS. 10A-10C, several embodiments of the nozzle projection caps 300, 310, 320 that may be formed at the first position 202 and inserted into the inlet opening 108 are illustrated. With reference to FIG. 10A, in some embodiments, the nozzle projection cap 300 at the first position 202 may define a plurality of projections 302 circumferentially disposed around a hub. In some embodiments, the nozzle projection cap 300 may include an end cap 304 disposed at a distal end of the nozzle projection cap with the end cap defining a diameter which extends to a distal end of the projections. In the depicted embodiment of FIG. 10A, the nozzle projection cap 300 extends into the washing chamber past the wall 103 of the tub 100, such that moisture-laden air enters the drying duct 200 around the end cap 304 between the projections 302 and the wall 103, such that the end cap 304 blocks liquid spray from directly entering the drying duct while still allowing moisture laden air to enter and the liquid therein to be condensed or otherwise removed from the air.

With reference to FIG. 10B, the nozzle projection cap 310 at the first position 202 may define a plurality of radially extending projections 312 and a hub 314 for positioning within the inlet opening 108. FIG. 10C depicts a nozzle projection cap 320 having four projections 322 and a hub 324. As detailed herein, the nozzle projection caps 310, 320 may extend up to, within, or through the inlet opening 108 in the tub 100 wall 103. As shown in the embodiments of FIGS. 5-10C, the nozzle projection cap 228, 300, 310, 320 may include any number of projections including, but not limited to, two, three, four, five, six, seven, eight, nine, ten, eleven, twelve, thirteen, fourteen, fifteen, sixteen, seventeen, eighteen, nineteen, twenty, twenty-one, twenty-two, twenty-three, twenty-four, twenty-five, twenty-six, twenty-seven, twenty-eight, twenty-nine, thirty, thirty-one, thirty-two, thirty-three, thirty-four, thirty-five, thirty-six, thirty-seven, thirty-eight, thirty-nine, or forty projections. In each of the depicted embodiments, the projections 232, 302, 312, 322 may be inserted into the inlet opening 108 in the wall 103 of the tub 101, and the projections may be configured to align the nozzle projection cap 228, 300, 310, 320 and thereby the drying duct 200 with the inlet opening. In such embodiments, moisture-laden air may flow between the edge of the inlet opening 108 and the nozzle projection cap 228, 300, 310, 320 to enter the drying duct 200. The hub 230, 314, 324 and end surfaces of the projections 232, 302, 312, 322 may also limit liquid spray (e.g., inadvertent spray from the spray arms during washing) into the drying duct 200.

Many further modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included herein. Although specific terms are employed herein, they are used in a generic and descriptive sense only and not for purposes of limitation.

The invention claimed is:

1. An apparatus for removing moisture as liquid from moisture-laden air in an appliance, the apparatus comprising:

a body comprising at least one elongate wall section, the body defining:

a channel extending from a first position to a second position, wherein the channel comprises a serpentine flow path between the first position and the second position, wherein the serpentine flow path is configured to redirect the moisture-laden air to remove at least some moisture as liquid from the moisture-laden air, and an opening in the body defined at least at the serpentine flow path, wherein the body is configured to be secured to a wall of a tub of an appliance, such that the opening in the body is configured to be at least partially closed by the wall of the tub at the serpentine flow path and the channel is configured to be at least partially bounded by the wall of the tub, and wherein in operation, the body is configured to cooperate with the wall to cause the moisture-laden air entering the channel at the first position through an inlet opening in the wall to pass into the serpentine flow path to remove the at least some moisture as the liquid from the moisture-laden air before the liquid exits the channel at the second position through an outlet opening in the wall.

2. The apparatus according to claim 1, further comprising a nozzle projection cap at the first position, wherein the nozzle projection cap is configured to extend up to or through the inlet opening in the wall of the tub of the appliance.

3. The apparatus according to claim 1, wherein the body comprises a plurality of projections oriented in alternating directions that define the serpentine flow path, wherein the plurality of projections are configured to facilitate removal of the at least some moisture from the moisture-laden air received therein.

4. The apparatus according to claim 1, wherein the body comprises a peripheral sealing surface defined along a perimeter of the opening and connected to one or more of the at least one elongate wall section, wherein the peripheral sealing surface is configured to prevent air in the serpentine flow path from escaping between the body and the wall at the perimeter of the opening.

5. The apparatus according to claim 4, further comprising a gasket disposed along the peripheral sealing surface, such that the gasket is configured to create a seal between the peripheral sealing surface and the wall of the tub of the appliance.

6. The apparatus according to claim 1, wherein the opening extends from the first position to the second position, such that the channel is configured to be at least partially bounded by the wall of the tub of the appliance continuously from the inlet opening at the first position to the outlet opening at the second position.

7. The apparatus according to claim 1, further comprising one or more attachment elements configured to secure the body to the washing tub.

8. The apparatus according to claim 1, wherein the body further defines one or more exhaust vents configured to allow air to vent to an ambient environment.

9. The apparatus according to claim 8, wherein the one or more exhaust vents are defined in one or more of the at least one elongate wall between the serpentine flow path and the second position.

10. The apparatus according to claim 1, wherein the body is formed as a single, integral piece.

11. The apparatus according to claim 1, wherein the at least one wall comprises at least two elongate walls collectively forming a contiguous inner surface of the body, and wherein the contiguous inner surface is at least partially curved.

12. The apparatus according to claim 1, wherein the body further defines an expansion chamber in the channel surrounding the first position.

13. The apparatus according to claim 1, wherein the body further defines a lower trough in the channel at the second position and configured to direct the liquid to the outlet opening.

14. An appliance comprising:

a tub defined at least in part by a wall, wherein the wall defines at least an inlet opening and an outlet opening; and a drying duct secured to the wall of the tub, wherein the drying duct comprises a body comprising at least one elongate wall section, the body defining:

a channel extending from a first position to a second position, wherein the first position corresponds to the inlet opening of the wall and the second position corresponds to the outlet opening of the wall, wherein the channel comprises a serpentine flow path between the first position and the second position, wherein the serpentine flow path is configured to redirect moisture-laden air to remove at least some moisture as liquid from the moisture-laden air, and an opening in the body defined at least at the serpentine flow path, wherein the opening in the body is at least partially closed by the wall of the tub at the serpentine flow path and the channel is bounded by the wall of the tub, and wherein in operation, the body is configured to cooperate with the wall to cause the moisture-laden air entering the channel at the first position from the tub through the inlet opening in the wall to pass into the serpentine flow path to remove the at least some moisture as the liquid from the moisture-laden air before the liquid exits the channel at the second position through the outlet opening in the wall into the tub.

15. The appliance according to claim 14, wherein the drying duct further comprises a nozzle projection cap at the first position, wherein the nozzle projection cap extends up to or through the inlet opening in the wall of the tub of the appliance.

16. The appliance according to claim 14, wherein the drying duct comprises a plurality of projections oriented in alternating directions that define the serpentine flow path, wherein the plurality of projections are configured to facilitate removal of the at least some moisture from the moisture-laden air received therein.

17. The appliance according to claim 14, wherein the drying duct comprises a peripheral sealing surface defined along a perimeter of the opening and connected to one or more of the at least one elongate wall section, wherein the peripheral sealing surface is configured to prevent air in the serpentine flow path from escaping between the body and the wall at the perimeter of the opening.

18. The appliance according to claim 17, wherein the drying duct further comprises a gasket disposed along the peripheral sealing surface, such that the gasket is configured to create a seal between the peripheral sealing surface and the wall of the tub of the appliance.

19. The appliance according to claim 14, wherein the opening of the drying duct extends from the first position to the second position, such that the channel is configured to be at least partially bounded by the wall of the tub of the appliance continuously from the inlet opening at the first position to the outlet opening at the second position.

20. The appliance according to claim 14, further comprising a vent assembly attached to the tub, wherein the vent assembly is configured to direct air into the tub to create a positive pressure in the tub so as to direct moisture laden air from the tub into the drying duct via the inlet opening in the wall.

21. The appliance according to claim 14, wherein the drying duct further defines one or more exhaust vents disposed between the serpentine flow path and the second position configured to allow air to vent to an ambient environment.

22. The apparatus according to claim 14, wherein the at least one elongate wall section comprises at least two elongate wall sections that collectively form a contiguous inner surface of the body, and wherein the contiguous inner surface is at least partially curved.

23. The apparatus according to claim 22, wherein the at least two elongate wall sections of the body collectively define a semi-circular cross-section at the serpentine flow path.

24. An appliance comprising:

a tub defined at least in part by a wall, wherein the wall defines at least an inlet opening and an outlet opening; and the apparatus according to claim 1.

* * * * *